US008474643B2

(12) United States Patent
Hundley et al.

(10) Patent No.: US 8,474,643 B2
(45) **Date of Patent: *Jul. 2, 2013**

(54) CUP LID HAVING A PERIMETER PORTION ADAPTED TO CAUSE LIQUID TO DRAIN TOWARD A CENTRAL PORTION OF THE LID

(75) Inventors: Bobby V. Hundley, Glendale, AZ (US); Joseph H. Quatmann, Phoenix, AZ (US)

(73) Assignee: New Wincup Holdings, Inc., Stone Mountain, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/175,129

(22) Filed: Jul. 1, 2011

(65) Prior Publication Data

US 2012/0024871 A1 Feb. 2, 2012

Related U.S. Application Data

(63) Continuation of application No. 11/402,514, filed on Apr. 11, 2006, now Pat. No. 7,992,741.

(60) Provisional application No. 60/670,348, filed on Apr. 11, 2005.

(51) Int. Cl.
*B65D 51/04* (2006.01)

(52) U.S. Cl.
USPC ..... 220/254.3; 220/253; 220/254.1; 220/254.5; 220/268; 220/711; 220/715; 220/717; D9/447; D9/449; 222/111

(58) Field of Classification Search
USPC ..... 220/254.1, 254.3, 254.5, 268, 711, 220/715, 717, 253; 222/111; D9/447, 449
See application file for complete search history.

(56) References Cited

U.S. PATENT DOCUMENTS

| | | | | |
|---|---|---|---|---|
| 4,589,569 | A * | 5/1986 | Clements | 220/380 |
| 6,612,456 | B1 * | 9/2003 | Hundley et al. | 220/254.3 |
| 7,591,393 | B2 * | 9/2009 | Crudgington, Jr. | 220/713 |
| 7,992,741 | B2 * | 8/2011 | Hundley et al. | 220/254.5 |
| 2003/0192890 | A1 * | 10/2003 | Mazzarolo | 220/254.3 |

* cited by examiner

*Primary Examiner* — Anthony Stashick
*Assistant Examiner* — Elizabeth Volz
(74) *Attorney, Agent, or Firm* — Condo Roccia LLP

(57) ABSTRACT

A lid for a drinking cup may include a rim portion and a raised cover portion. The rim portion may be adapted to matingly engage an upper peripheral edge of the drinking cup so as to selectively maintain the lid in a covering relationship on the cup. The raised cover portion may extend from the rim portion, and have a perimeter adapted to impede spillage of liquid over a peripheral edge of the lid. Liquid spilled or released on the cover portion or perimeter portion may drain away from the periphery of the cover portion and into the drinking opening or a recess in the cover portion that is adapted to receive a reclosable tab.

19 Claims, 4 Drawing Sheets

CUP LID HAVING A PERIMETER PORTION ADAPTED TO CAUSE LIQUID TO DRAIN TOWARD A CENTRAL PORTION OF THE LID

CROSS-REFERENCE TO RELATED APPLICATIONS

This application is a continuation of U.S. patent application Ser. No. 11/402,514, which claims benefit under 35 U.S.C. §.119(e) of provisional U.S. Patent Application No. 60/670,348, the disclosures of which are incorporated herein by reference.

FIELD OF THE INVENTION

The invention relates generally to cup lids. More-particularly, the invention relates to a reclosable cup lid having a central portion and a perimeter portion adapted to cause liquid to drain away from the perimeter portion into the central portion.

BACKGROUND OF THE INVENTION

Fast food restaurants, coffee shops, convenience stores, and the like, typically distribute Beverages in disposable drinking cups. Such cups are often provided with drink-through lids that allow for the consumption of liquids contained therein, while at the same time preventing unwanted spillage. Drink-through lids with reversible openings are especially desirable when distributing hot beverages, such as coffee, tea, hot chocolate, and the like (see, for example, U.S. Pat. No. 6,612,456, the disclosure of which is incorporated herein by reference).

In a typical lid, spillage of the liquid contents may occur through the drinking opening. Many lid designs provide little or no mechanism for containing liquid spilled through the drinking opening. Such liquid often continues over the edges of the cup lid and possibly onto the drinker. In some designs, liquid may be captured in an area of the lid that is adjacent to the drinking opening. Especially in the case of hot beverages, heat transfer from liquid captured in such a way may cause discomfort to the drinker. It would be advantageous, therefore, if lids were available that caused spillage to drain toward a center portion of the lid and impeded further spillage over the edges of the lid.

SUMMARY OF THE INVENTION

The invention provides a lid for a drinking cup having a rim portion and a raised cover portion extending from the rim portion. The rim portion may be adapted to matingly engage an upper peripheral edge of a drinking cup so as to selectively maintain the lid in a covering relationship on the cup. The raised cover portion may have a perimeter adapted to impede spillage of liquid over a peripheral edge of the lid. The perimeter of the raised cover portion may be adapted to cause liquid to drain away from the perimeter into a central portion of the lid.

The perimeter portion may define a sipping ledge that extends from the drinking opening. The sipping ledge may have a height above the drinking opening of more than about 0.6875" in order to provide adequate surface area to accommodate a drinker's lower lip. The sipping ledge may have a width along the perimeter of the lid of more than about 0.75", for example, so that the sipping ledge would feel to a drinker as the edge of an open cup. The sipping ledge may have a thickness of less than about 0.316", for example, to minimize the amount of liquid captured directly adjacent to the drinker's bottom lip, thereby reducing discomfort to the drinker due to heat transfer that may occur in the case of hot liquids.

The raised cover portion may define a hinged portion having a hollow raised tab integrally formed thereon. The hinged portion may be rotatable about an integrally formed hinge so as to provide a drinking opening in the lid. The tab may have a rear wall terminating in the hinge. The raised cover portion may also define a recess integrally formed on the central portion of the lid. The recess may have a foremost edge defined by the hinge. The hinged portion may be outwardly rotatable about the hinge such that the hollow raised tab is received in detachably locking engagement in the recess. The recess may include a sidewall and an interference member extending from the sidewall for retaining the raised tab in the recess. The perimeter of the raised cover portion may be adapted to cause the liquid to drain into the recess.

Such a lid may provide any of a number of advantages. For example, spilled coffee may be retained well away from a user's lips. The lid may have a contoured profile with a sloped ledge that is higher than the lid center to help retain spilled liquid.

The lid may be used to seal a drinking cup when it is served to customers. A plug-fit or snap-over seal may be provided. A hinged, reclosable tab may make the lid splash resistant. The tab may hinge well out of the way of upper lip to provide a feel that is likely to satisfy many coffee drinkers' preference for a non-interfering "tear-out" tab. The lid may include identification bubbles, and clear directional nomenclature (e.g., "Fold-Back"), which may be raised to improve visibility. The lid may be a one piece design with integrated closure that is simple in construction and, consequently, cost-effective to manufacture using conventional vacuum forming and die cutting techniques.

A wide sip opening may provide the ability to add condiments such as cream and sugar without removing the lid. The lid may be custom-fit to existing cup sizes. One size lid may fit several cup sizes (e.g., 12, 16, and 20 oz cups). The height of the sip area may be appropriate to allow a drinker's top and bottom lips to engage the lid. The lid may be embossed. The lid may be provided with a heat management mechanism, such as a corrugated sipping surface, so that it is comfortable to drink from without the user's burning his mouth.

DETAILED DESCRIPTION OF ILLUSTRATIVE EMBODIMENTS

Figure 1:
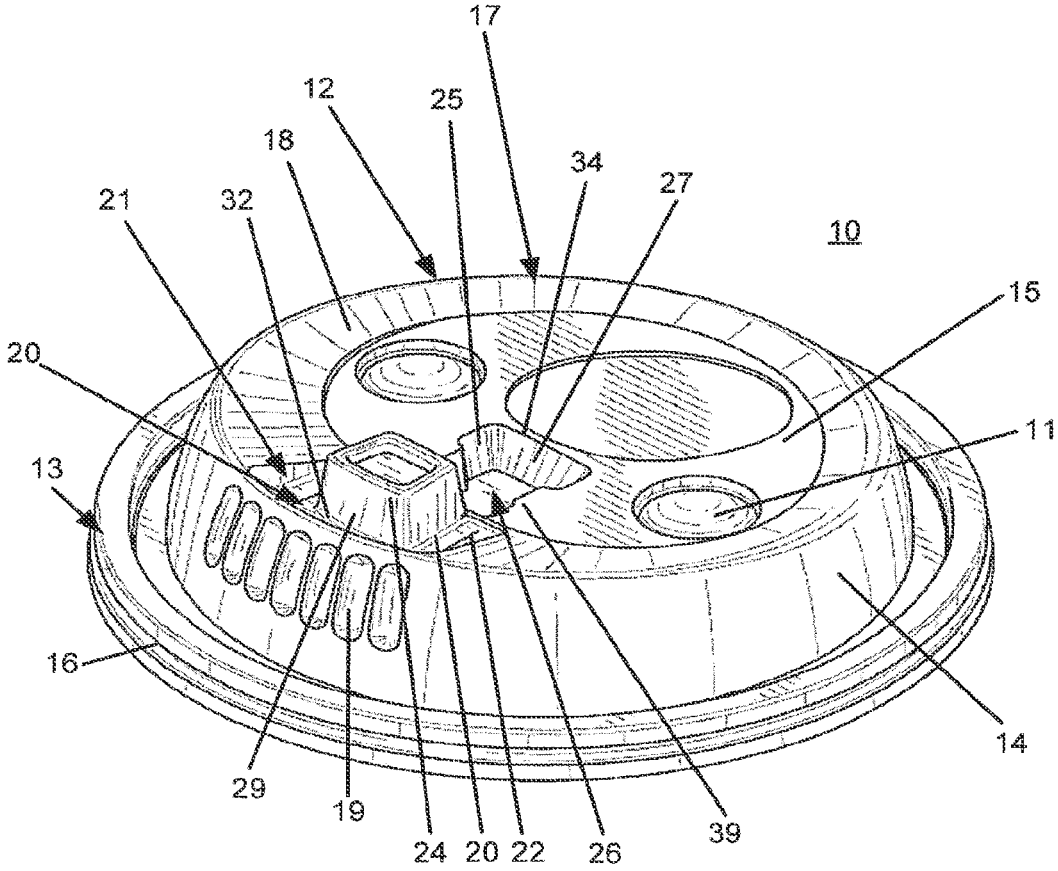
FIGS. 1-5 are isometric, top, side, front, and rear views, respectively, of an example embodiment of a cup lid having a perimeter portion that is adapted to cause liquid to drain toward a central portion of the lid.
Figure 2:
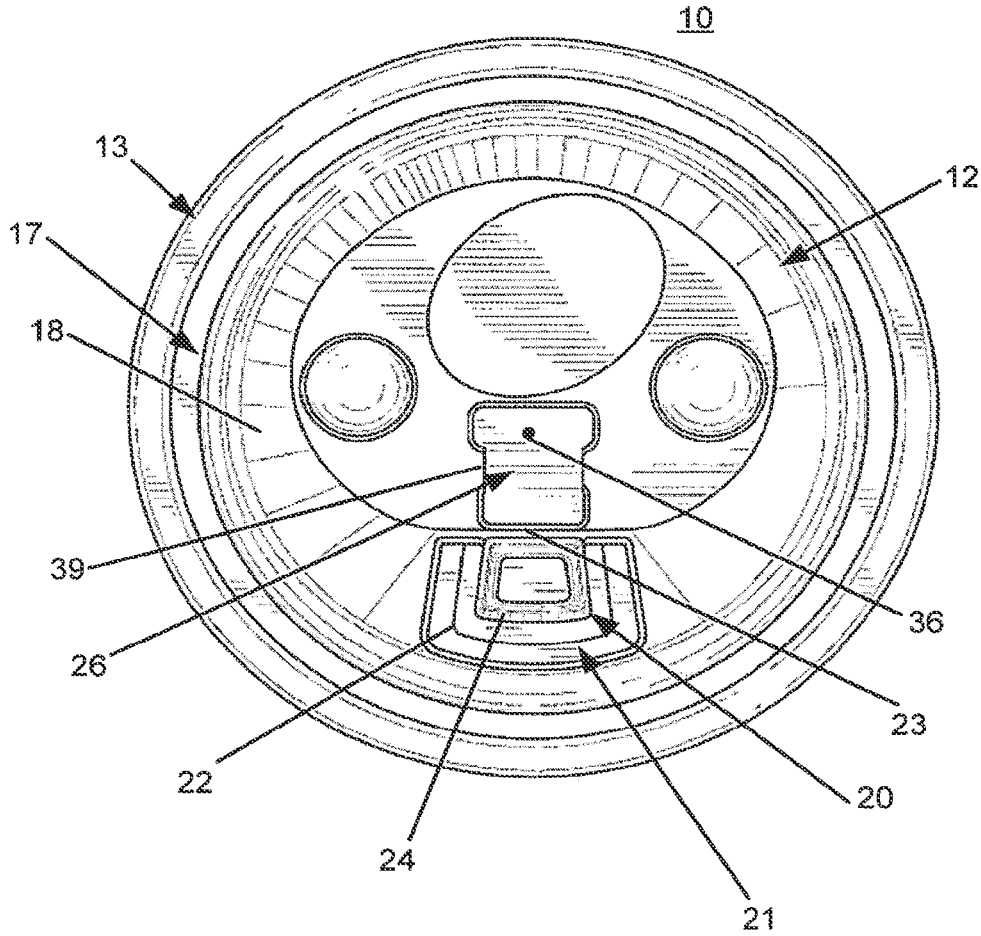

A cup lid 10 as shown in FIGS. 1-5 may include a cover portion 12 and a rim portion 13. The cover portion 12 may be a raised cover portion that includes a peripheral wall 14 and a central portion 15. The central portion 15 may be generally planar, and may have a curved perimeter. The central portion 15 may be generally circular or elliptical in shape. The cover portion 12 may also include one or more identification bubbles 11 that may be used to identify the contents of the cup. For example, the identification bubbles 11 might be depressed to identify whether the liquid contained therein is regular coffee or decaffeinated coffee.

A plurality of narrow corrugations 19 may also be provided in the peripheral wall 14, proximate to the drinking opening 32. Such narrow corrugations 19 may serve to insulate a drinker's lower lip from discomfort due to hot liquid in the cup bearing against the internal surface of the lid 10. The corrugations 19 may limit contact between the drinker's lower lip and the cup lid 10, while providing increased surface area for improved heat dissipation. At the same time, air may be temporarily trapped in the corrugations providing further insulative capacity.

The rim portion 13 may include a circumferential depending skirt 16 that defines an internal, downward-facing, annular groove adapted to matingly engage a complementary peripheral rim of a container (not shown), such as a drinking cup, for example.

A hinged portion 20 may be formed in the cover portion 12. The hinged portion 20 may be defined by a substantially U-shaped slit 22 or line of weakened cross-section in or through the cover portion 12. The U-shaped slit 22 may be formed with the "U" facing inwardly toward the central portion 15 of the lid 10. The slit 22 may define a hinge 23. The hinge 23 may be a linear hinge.

A tab 24 may be integrally formed in the hinged portion 20. The tab 24 may be a hollow, raised tab. For example, the tab 24 may be a hollow, generally cube-shaped, open-bottomed member that protrudes above the plane of the central portion 15 of the lid 10, though the tab 24 may have any shape. The tab 24 may be engaged by the user to rotate the hinged portion 20 about the hinge 23 up and out of the plane of the cover portion 12 of the lid to produce a drinking opening therein. The hinged portion 20 may be a reversible hinged portion such that the tab 24 may also be engaged to depress the hinged portion 20 inward about the hinge 23 to produce a drinking opening. Thus configured, the tab 24 may make insulative contact with the upper lip of a drinker, thereby protecting the drinker's upper lip from discomfort due to the hot liquid bearing against the bottom surface of the lid 10 during drinking.

The tab 24 may include any combination of ridges, grooves, or corrugations in order to increase the heat-dissipating surfaces of the tab 24. The tab 24 may also include a vent hole (not shown) in the top or side thereof to allow steam to escape from inside the cup. The tab 24 may also be formed with directive arrows (not shown) to provide instructions to the user as to how to operate the tab, or embossed with a logo, for example, for marketing purposes.

The hinged portion 20 may reside in a well 21 provided in the central cover portion 12. The well 21 may direct excess liquid back into the drinking opening 32. In addition, the well 21 may insulate the lips of the drinker from direct contact with the die-cut edges of the drinking opening 32, which may be sharp, to provide a comfortable drinking experience.

A recess 26 may be integrally formed on the cover portion 12 of the lid 10, adjacent to hinged portion 20. The recess 26 may extend from the hinged portion 20 toward the central portion 15 of the cover portion 12, and may include a foremost edge that is defined by the hinge 23. The recess 26 may have a shape that is adapted to receive the tab 24. The shape of the recess 26 may be substantially complementary to the shape of the tab 24 (e.g., generally cubical). The recess 26 may be defined by one or more sidewalls 25. One or more of the sidewalls 25 may include an interference member 39 that extends from the sidewall 25 for retaining the raised tab 24 in the recess 26 via an interference fit between the tab 24 and the interference member 39.

The front wall 29 of the tab 24 may have a protruding rib (not shown) that engages the back wall 27 of the recess 26 when the tab 24 is inserted therein, thereby selectively detachably locking the hinged portion 20 in an open position (see U.S. Pat. No. 6,612,456). The back wall 27 of the recess 26 may include a complementary notch or detent to receive the rib. One or more pairs of complementary male and female engaging features may be provided in the tab 24 and/or the recess 26 to provide for such detachable locking engagement. Further, the top edge 34 of back wall 27 may be provided with a tapered profile to facilitate insertion of the tab 24 into recess 26.

Figure 3:
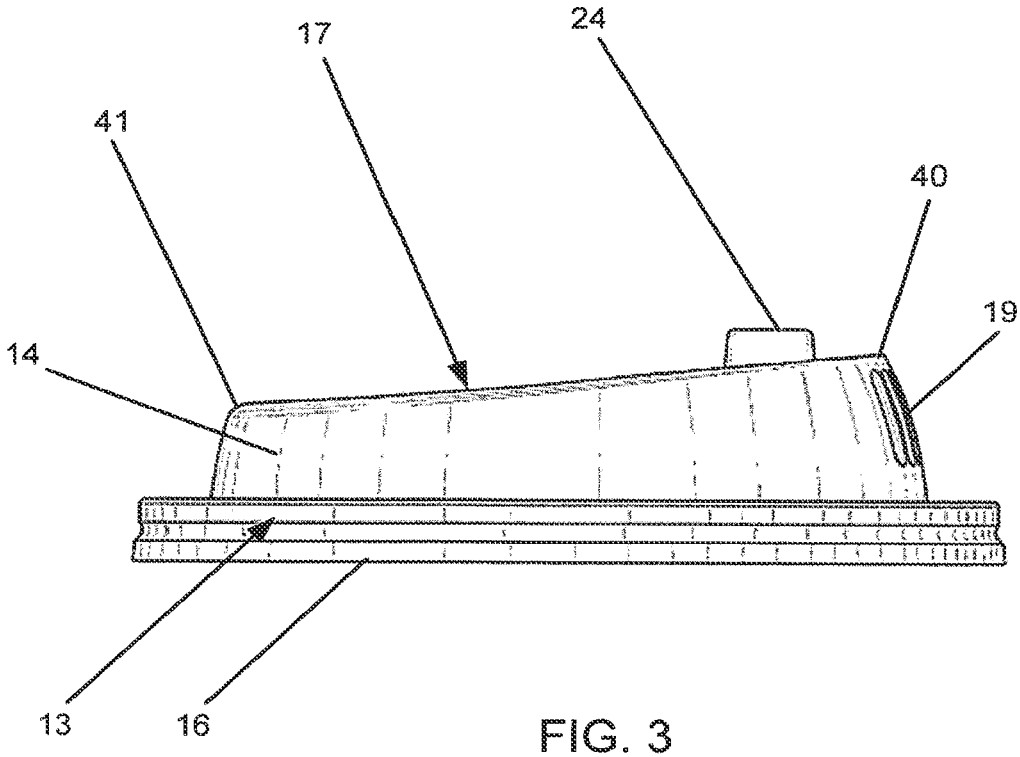
Figure 4:
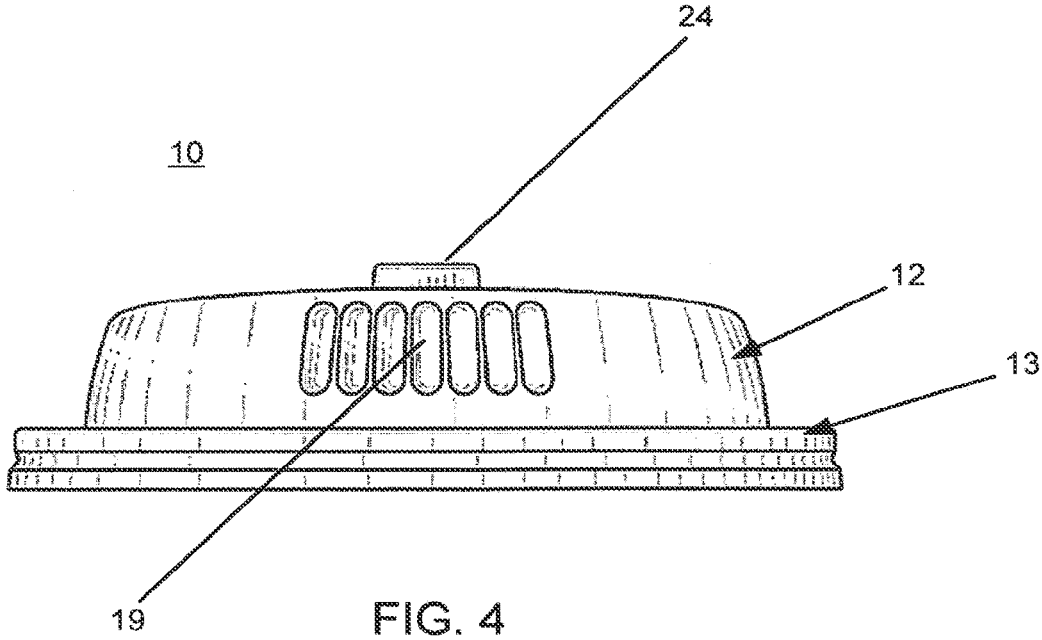
Figure 5:
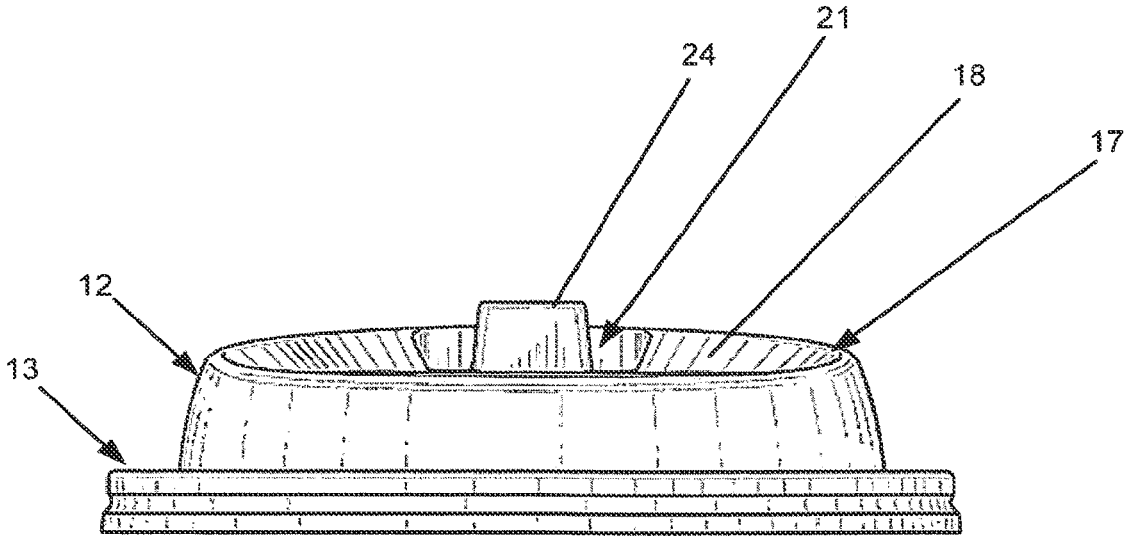

The central cover portion 12 may include a perimeter portion 17. The perimeter portion 17 may define the central portion 15, and may extend up to 360.degree. around the periphery of the lid 10. As shown, the perimeter portion 17 may be contoured. That is, the perimeter portion 17 may vary in height, relative to the plane of the central portion 15, along the periphery of the lid 10. For example, as best seen in FIG. 3, the height of the perimeter portion 17 at a point 40 in the vicinity of the drinking opening 32 may be different from the height of the perimeter portion 17 at a point 41 that is 180.degree. around the periphery from the drinking opening 32. The front height may be about ⅝" to ¾" above the ring, with ⅝" representing roughly a minimum for lip clearance, to a back height that can be as low as the ring itself. However, this much slope may tend to minimize the clearance under the dome for toppings.

The perimeter portion 17 may have a sloped surface 18 extending from the top of the perimeter portion 17. The surface 18 may slope downwardly from the top of the perimeter portion 17 and inwardly toward the central portion 15 of the lid 10. The plane of the central portion 15 may be lower than the bottom of the sloped surface 18, as shown, or it may be at the same height. The sloped surface 18 may be substantially straight, or it may be curved as shown.

The sloped surface 18 may form a first angle with the peripheral wall 14 of the cover portion 12, and a second angle with the plane of the central portion 15 of the cover portion 12. The first angle may be in a range of about 0-90.degree., or of about 25-90.degree., for example. It is expected that, the closer the first angle is to zero, the more optimal the lid is likely to be from a drinking standpoint. Preferably, the second angle is as near to zero as possible.

As shown, the radial width of the sloped surface 18 may vary around the perimeter of the lid. That is, the distance (as measured projected from the sloped surface 18 into the plane of the central portion 15) from the perimeter portion 17 to the central portion 15 may vary around the perimeter if the lid.

Thus, liquid spilled into the central portion 15 may be contained in the central portion 15, and drained away from the periphery of the lid, via the sloped surface 18. That is, the sloped surface 18 tends to impede the flow of liquid out of the central portion and over the side of the lid. Further, the sloped surface 18 may be adapted, as shown, to cause liquid to drain toward or into the drinking opening 32 or the recess 26. The recess 26 may include a drainage opening 36 in its bottom surface to return liquid received into the recess 26 back to the cup (see FIG. 2).

The lid 10 may be made of a thermoplastic material, such as, high-impact polystyrene (HIPS), polypropylene, or polyethylene terephthalate (PET), for example, that, preferably, can withstand temperatures exceeding 200.degree. F. The lid 10 may be made by any of a number of well-known thermoforming techniques. The lid 10 may be manufactured in any of a plurality of colors and may be embossed with logos or trademarks, for example, if desired.

The lid 10 may have any diameter, and may be made to fit various size cups including, for example, 12-ounce, 16-ounce, and 20-ounce cups. For example, the lid may have a diameter between about 3" and 5". The drinking opening 32 may be approximately 0.750".times.0.575", for example. The drinking opening 32 may be large enough to allow for direct introduction of condiments, such as creamer and sugar, for example, and thus may eliminate the need for removal of the lid. The tab 24 may be approximately 0.5".times.0.375".times.0.350", for example, and the recess 26 may have dimensions that are substantially equivalent to those of the tab. The central cover portion 12 may be sized such that the bottom of the recess 26 is above the plane of the rim engaging portion 13.

The height of the perimeter portion 17 near the drinking opening 32 may be such that the sipping ledge feels to the drinker like the upper edge of an open cup. For example, near the drinking opening 32, the perimeter portion 17 may have a height between about 0.5" and about 0.75", and preferably of about 0.6875", above the plane of the drinking opening 32. The thickness of the sipping ledge may be sufficiently narrow to limit the amount of liquid captured directly adjacent to the user's bottom lip, thereby reducing heat transfer.

In operation, the drink-through lid 10 may be selectively snap-mounted onto any desired drinking cup, with the annular groove of the rim portion engaging the upper peripheral edge of the cup. With lid 10 properly engaged with the cup, there may be two ways via which a user may drink from the cup.

In a first scenario, the user may raise the cup to his mouth and begin tilting the cup so that the lid 10 moves into engagement with the user's lips. In this position, the upper lip of the user may engage the protruding tab 24 of hinged portion 20 and the lower lip of the user may engage the peripheral wall 14 of the lid 10. As the upper lip or tongue of the user presses against the protruding tab 24, the hinged portion 20 may be depressed below the plane of the cup lid 10 creating an opening 32 in the lid 10 through which liquid flows into the mouth of the user.

The tipping of the cup may cause liquid to flow against the lid 10. In the case of hot beverages such as, coffee, tea, hot chocolate, etc., the lips of the user may become uncomfortable due to the hot liquid bearing against the internal surface of the lid 10. The corrugations 19 in the peripheral wall 14 of the lid 10 may provide increased surface area to dissipate the heat of the liquid, thereby reducing the likelihood that a user drinking a hot beverage will experience discomfort, particularly on the user's lower lip. Air pockets may also be temporarily formed in the corrugations 19 as well as in the tab 24, further insulating the users lips and mouth.

After the user has taken a sip or drink of liquid, the user removes the cup away from his mouth, thereby removing his upper lip or tongue from contact with the tab 24. With the pressure from the user's upper lip or tongue removed from the tab, the hinged portion 20 springs back to its normally closed position. The hinge 23 can be, for example, a tension style hinge that provides spring-back to improve the closure seal. Such quick closing action and seal may prevent accidental spillage.

In a second mode of operation, the hinged portion 20 of the lid 10 may be rotated up and out of the plane of the cup lid 10, before the user raises the cup to his mouth. Rotation of the hinged portion 20 of the cup lid 10 creates the drinking opening 32 through which liquid can flow through the lid 10. With the hinged portion 20 in a closed position, the tab 24 protrudes substantially from the plane of the lid 10. This feature permits the user to easily open the hinged portion 20 of the lid 10. For example, by engaging the foremost edge of the tab 24 with a thumb, a user can gain enough mechanical leverage to overcome the U-shaped weakened cross section of the hinged portion and/or the resilient bias of integrally formed hinge 23, to flip up the hinged portion 20 of the cup lid 10. Once lifted out of the plane of the cup lid, the user can continue to rotate the hinged portion 20 approximately 180 degrees about the hinge 23, until the now inverted tab 24 is received in complementary recess 26.

As the user presses the tab 24 into the recess 26, the sidewalls of the tab 24 frictionally engage the interference members 39 protruding from the sidewalls of the recess 26. Thus, the tab may be detachably locked in nested engagement with the recess 26.

When received in the recess 26, the tab 24 can be biased against the back wall 27 by the hinge 23. The hinge 23 may have an arc that provides a biasing force that presses the tab 24 against the back wall 27 of recess 26. The biasing of the tab 24 can be further augmented by the resilient foreshortening of the back wall of recess 26 as the tab is pressed into locking engagement with recess 26. Such foreshortening or buckling laterally displaces hinge 23 toward the back wall 27 of recess 26, further biasing the tab 24 in recess 26.

What is claimed:

1. A lid for a drinking cup, the lid comprising:

a rim portion adapted to matingly engage the drinking cup so as to selectively maintain the lid in a covering relationship on the drinking cup;

a cover portion extending from the rim portion, the cover portion having a central portion with a planar surface and a perimeter portion that defines a perimeter around the central portion, the perimeter portion having a sloped surface extending from the perimeter of the central portion and 360° around a periphery of the lid, the sloped surface being adapted to drain liquid away from the periphery of the lid;

a recess integrally formed in the planar surface adapted to receive a hinged portion movable to produce a drinking opening in the lid; and a drainage opening through the planar surface, the drainage opening being adapted to receive and return the liquid drained by the sloped surface back into the drinking cup.

2. The lid of claim 1, wherein the sloped surface has a radial width that varies around the perimeter portion of the lid.

3. The lid of claim 1, wherein the sloped surface has an upper end and a lower end, and the planar surface defined by the central portion is below the lower end of the sloped surface.

4. The lid of claim 1, wherein the sloped surface extends at a first angle from a top of the perimeter portion, and at a second angle from the central portion.

5. The lid of claim 1, wherein the sloped surface is at least one of the following: generally straight or generally curved.

6. The lid of claim 1, wherein the hinged portion comprises a tab integrally formed on the cover portion to provide the drinking opening in the lid.

7. The lid of claim 6, wherein the tab and the drinking opening are formed within the perimeter portion.

8. The lid of claim 6, wherein the hinged portion further comprises a hinge integrally formed on the central portion.

9. The lid of claim 8, wherein the hinged portion is selectively outwardly rotatable about the hinge so as to provide the drinking opening in the lid.

10. The lid of claim 8, wherein the tab has a rear wall terminating in the hinge.

11. The lid of claim 8, wherein the perimeter portion is generally circular and the hinge is linear.

12. The lid of claim 8, wherein the recess comprises a foremost edge defined by the hinge.

13. The lid of claim 12, wherein the recess further comprises a sidewall and an interference member extending from the sidewall for retaining the tab in the recess.

14. The lid of claim 6, wherein the perimeter portion defines a sipping ledge that extends from the drinking opening.

15. The lid of claim 14, wherein the sipping ledge has a height above the drinking opening of more than about 0.6875".

16. The lid of claim 14, wherein the sipping ledge has a thickness that is sufficiently narrow to minimize an amount of liquid captured directly adjacent to a drinker's bottom lip, thereby reducing discomfort to the drinker due to heat transfer that may occur in the case of hot liquids.

17. A lid for a drinking cup, the lid comprising:

a rim portion adapted to matingly engage the drinking cup so as to selectively maintain the lid in a covering relationship on the drinking cup;

a cover portion extending from the rim portion, the cover portion having a central portion with a planar surface and a perimeter portion that defines a perimeter around the central portion, the perimeter portion having a sloped surface extending from the perimeter of the central portion, the sloped surface being adapted to drain liquid away from a periphery of the lid;

a hinged portion defined within the cover portion and having a tab integrally formed thereon, the tab being totally recessed within the sloped surface of the perimeter portion, the hinged portion being rotatable about a hinge so as to provide a drinking opening in the lid, wherein the hinge is integrally formed in the planar surface along the perimeter of the central portion that is defined by the perimeter portion of the cover portion; and a recess integrally formed in the planar surface adapted to receive the tab; and a drainage opening defined through the planar portion, the drainage opening being adapted to receive and return the liquid drained by the sloped surface back into the drinking cup.

18. The lid of claim 17, wherein the sloped surface further extends 360° around the periphery of the lid.

19. The lid of claim 17, wherein the sloped surface has a radial width that varies around the perimeter portion of the lid.

* * * * *